US011221578B2

(12) United States Patent
Kimura et al.

(10) Patent No.: US 11,221,578 B2
(45) Date of Patent: Jan. 11, 2022

(54) IMAGE FORMING APPARATUS THAT DETECTS DETERIORATION OF A SPRING USED TO BIAS A SHEET LOCKING MEMBER

(71) Applicant: Konica Minolta, Inc., Tokyo (JP)

(72) Inventors: Taku Kimura, Toyokawa (JP); Masahiro Kamiya, Toyohashi (JP); Junichi Masuda, Toyokawa (JP); Masahiro Nonoyama, Toyokawa (JP); Kouei Cho, Toyohashi (JP); Akimasa Ishikawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 155 days.

(21) Appl. No.: 16/703,238

(22) Filed: Dec. 4, 2019

(65) Prior Publication Data

US 2020/0201233 A1 Jun. 25, 2020

(30) Foreign Application Priority Data

Dec. 25, 2018 (JP) ..... JP2018-240906

(51) Int. Cl.
*G03G 15/00* (2006.01)
*B65H 9/00* (2006.01)
*B65H 5/06* (2006.01)

(52) U.S. Cl.
CPC ..... *G03G 15/6567* (2013.01); *B65H 5/062* (2013.01); *B65H 9/004* (2013.01); *G03G 15/6564* (2013.01); *B65H 2511/242* (2013.01)

(58) Field of Classification Search
CPC ..... G03G 15/6564; G03G 15/6567; G03G 15/6558; G03G 15/6561; B65H 5/062; B65H 9/004; B65H 2511/242
See application file for complete search history.

(56) References Cited

U.S. PATENT DOCUMENTS 6,011,948 A * 1/2000 Amano ..... B65H 9/06 271/245
6,326,898 B1 * 12/2001 O'Leyar ..... H01F 7/1844 340/635
7,308,227 B2 * 12/2007 Ahn ..... G03G 15/6564 399/388
9,463,941 B2 * 10/2016 Mori ..... B65H 7/02
(Continued)

FOREIGN PATENT DOCUMENTS

JP 2011-190026 A 9/2011

*Primary Examiner* — Justin N Olamit
(74) *Attorney, Agent, or Firm* — Osha Bergman Watanabe & Burton LLP

(57) ABSTRACT

An image forming apparatus includes: a conveyance path that conveys a sheet; registration rollers that are arranged across the conveyance path and each comprise a nip part; a sheet locking member that locks a front end of a sheet conveyed in the conveyance path, where the sheet locking member swings between a first attitude and a second attitude, in the first attitude the sheet locking member locks the sheet on an upstream side of the nip part, and in the second attitude the sheet locking member is retracted to a downstream side of the nip part and allows the sheet to pass through the nip part; an energizer that energizes the sheet locking member to maintain the first attitude; and a hardware processor that detects deterioration of the energizer.

17 Claims, 16 Drawing Sheets

(56) References Cited

U.S. PATENT DOCUMENTS

| | | | | |
|---|---|---|---|---|
| 9,736,580 | B2 * | 8/2017 | Cahill | G01S 3/801 |
| 2006/0120781 | A1 * | 6/2006 | Ha | B65H 9/06<br>399/395 |

* cited by examiner

FIG. 12A

56

| SHEET TYPE | DETERMINATION REFERENCE VALUE |
|---|---|
| THIN PAPER | 200ms |
| PLAIN PAPER | 150ms |
| HEAVY PAPER | 100ms |

FIG. 12B

56

| SHEET TYPE | RESOLUTION | CONVEYANCE SPEED | DETERMINATION REFERENCE VALUE |
|---|---|---|---|
| PLAIN PAPER | 600dpi | 240mm/s | 150ms |
| | 1200dpi | 120mm/s | 300ms |

IMAGE FORMING APPARATUS THAT DETECTS DETERIORATION OF A SPRING USED TO BIAS A SHEET LOCKING MEMBER

CROSS-REFERENCE TO RELATED APPLICATION

The entire disclosure of Japanese patent Application No. 2018-240906, filed on Dec. 25, 2018, is incorporated herein by reference.

BACKGROUND

Technical Field

The present invention relates to an image forming apparatus, an image forming system, and a deterioration detection method, and more particularly to technology for detecting deterioration of a mechanism that performs sheet skew correction.

Description of the Related Art

In the related art, a mechanism in which gate members (shutter members) that contact the front end of a sheet upstream of a nip part of a pair of registration rollers and lock the front end of the sheet is known as a mechanism for correcting the skew of a sheet in an image forming apparatus (for example, JP 2011-190026 A). The gate members include a plurality of sheet locking parts arranged along a direction perpendicular to the sheet conveyance direction, and performs skew correction of the sheet by causing the front end of the sheet to be in contact with each of the multiple sheet locking parts.

Such gate members can swing between a first attitude in which the sheet locking parts are positioned upstream of the nip part of the registration rollers and lock the front end of a sheet and a second attitude in which the sheet locking parts move downstream of the nip part of the registration rollers to allow the sheet to pass therethrough. It is necessary to cause the gate members to quickly return to the first attitude after the sheet passes. Therefore, the gate members are provided with an energizer such as a coil spring. The energizer energizes the gate members to maintain the first attitude and causes the gate members in the second attitude to return to the first attitude.

An energizer provided to gate members in the above manner deteriorates over time. In particular, the energizer constantly applies the energizing force to hold the gate members in the first attitude, and thus the energizing force deteriorates with the passage of time. When the energizer deteriorates, it takes longer to return from the second attitude to the first attitude after the sheet passes through the gate members, thus resulting in an event in which the gate members cannot return to the first attitude by the time a next sheet is conveyed. Moreover, when the energizer is deteriorated, another event that the gate members do not return to the original first attitude also occurs. When these events occur, sheet skew correction cannot be performed properly during image formation, thus resulting in a disadvantage that failures such as defective image formation or paper jam occur frequently.

In order to solve this disadvantage, it is necessary in the related art to replace the energizer every time a certain period of time elapses. However, since the degree of progress of deterioration of the energizer is affected by the installation environment of the image forming apparatus, the frequency of use by the user, or other factors, it generally varies from apparatus to apparatus. For this reason, even when a maintenance person visits the customer to replace the energizer after a certain period of time has elapsed, there are cases where deterioration has not progressed as expected and it is found that no replacement is necessary. In this case, the visit of the maintenance person is wasted, thus hindering efficient work.

Therefore, in recent years, it has been desired to accurately grasp the replacement time of energizer. However, there is no technology for grasping the replacement time of energizer in the related art.

SUMMARY

One or more embodiments of the present invention provide an image forming apparatus, an image forming system, and a deterioration detection method capable of detecting the deterioration state of an energizer and grasping a replacement time.

According to one or more embodiments of the present invention, an image forming apparatus comprises: a conveyance path that conveys a sheet; a pair of registration rollers arranged across the conveyance path; a gate member (sheet locking member) comprising a sheet locking part that locks a front end of a sheet that is conveyed in the conveyance path, the sheet locking part being capable of swinging between a first attitude in which the sheet locking part can lock the sheet on an upstream side of a nip part of the pair of registration rollers and a second attitude in which the sheet locking part is retracted to a downstream side of the nip part to allow the sheet to pass through the nip part; an energizer that energizes the gate member to maintain the first attitude; and a hardware processor that detects deterioration of the energizer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 12A and 12B are tables illustrating an example of determination reference information according to one or more embodiments;

DETAILED DESCRIPTION

Figure 1:
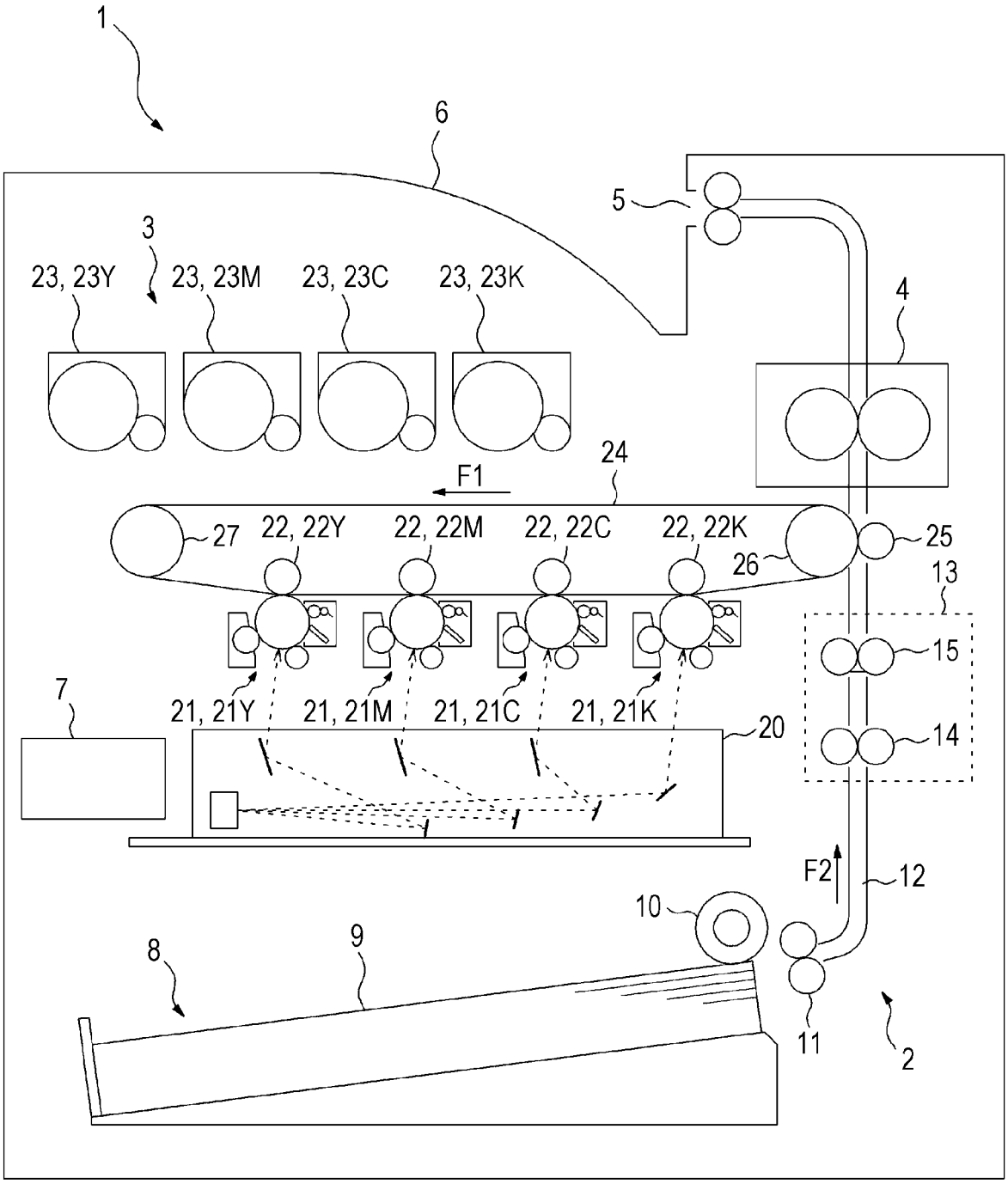
FIG. 1 is a diagram illustrating a configuration example of an image forming apparatus according to one or more embodiments.

Hereinafter, embodiments of the present invention will be described with reference to the drawings. However, the scope of the invention is not limited to the disclosed embodiments. Note that elements that are common to embodiments described below are denoted by the same reference numeral, and redundant description thereof is omitted.

Configuration of Image Forming Apparatus

FIG. 1 is a diagram illustrating a configuration example of an image forming apparatus 1 according to one or more embodiments of the present invention. The image forming apparatus 1 illustrated in FIG. 1 is a printer that forms an image on a sheet 9 such as printing paper by an electrophotographic system, and is capable of forming a color image by a tandem system. The image forming apparatus 1 includes a conveyor 2, an image former 3, and a fixer 4 inside the apparatus main body, and conveys sheets 9 stored in a lower sheet feeding cassette 8 one by one, forms a color image or a monochrome image on the sheet 9, and ejects the sheet 9 from an upper ejecting port 5 onto a paper ejecting tray 6. The image forming apparatus 1 also includes a controller 7 inside the apparatus main body. The controller 7 controls the operation of each component such as the conveyor 2, the image former 3, and the fixer 4.

The conveyor 2 includes the sheet feeding cassette 8, a pickup roller 10, a pair of sheet feeding rollers 11, a conveyance path 12, a skew corrector 13, and a secondary transfer roller 25. The sheet feeding cassette 8 is a container that stores a bundle of sheets 9. The pickup roller 10 takes out the uppermost sheet 9 of the bundle of sheets 9 stored in the sheet feeding cassette 8 and feeds it to the sheet feeding rollers 11. Note that there are cases where the pickup roller 10 feeds a plurality of sheets 9 to the downstream side of the sheet feeding cassette 8. The pair of sheet feeding rollers 11 extracts only one sheet 9 located at the uppermost position from the one or the plurality of sheets 9 fed by the pickup roller 10 and supplies the sheet 9 to the downstream conveyance path 12.

The conveyance path 12 is a path for conveying a sheet 9 in the direction of an arrow F2. A sheet 9 conveyed on the conveyance path 12 is subjected to skew correction by the skew corrector 13. The skew corrector 13 includes a pair of conveyance rollers 14 and a pair of registration rollers 15. The skew corrector 13 corrects the skew of the sheet 9 on the upstream side of the pair of registration rollers 15, and then temporarily stops the conveyance of the sheet 9 when the front end of the sheet 9 is held by the pair of registration rollers 15. The registration roller 15 conveys the sheet 9 to the position of the secondary transfer roller 25 at the same timing at which a toner image formed by the image former 3 moves to the position of the secondary transfer roller 25. The sheet 9 is transferred with the toner image when passing through the nip position of the secondary transfer roller 25, and thereafter fixing processing of the toner image transferred to the paper surface is performed when the sheet 9 passes through the fixer 4. The fixer 4 fixes the toner image on the sheet 9 by subjecting the conveyed sheet 9 to heat treatment and pressure treatment. Thereafter, the sheet 9 is ejected from the ejecting port 5 onto the paper ejecting tray 6.

The image former 3 forms toner images of four colors of yellow (Y), magenta (M), cyan (C), and black (K), and is capable of transferring the toner images of the four colors simultaneously to the sheet 9 passing through the position of the secondary transfer roller 25. The image former 3 includes an exposure unit 20, image forming units 21 (21Y, 21M, 21C, and 21K) provided for toners of the respective colors, primary transfer rollers 22 (22Y, 22M, 22C, and 22K) provided for each of the image forming units 21, an intermediate transfer belt 24, and toner bottles 23 (23Y, 23M, 23C, and 23K) of the respective colors. The four image forming units 21Y, 21M, 21C, and 21K are provided below the intermediate transfer belt 24, and the exposure unit 20 is provided further below the four image forming units 21Y, 21M, 21C, and 21K. The toner bottles 23Y, 23M, 23C, and 23K supply toner of the respective colors to the four image forming units 21Y, 21M, 21C, and 21K, respectively.

The exposure unit 20 exposes an image carrier (photoreceptor drum) included in each of the image forming units 21Y, 21M, 21C, and 21K to form a latent image on the image carrier of each of the image forming units 21Y, 21M, 21C, and 21K. Each of the image forming units 21Y, 21M, 21C, and 21K forms a toner image on the surface of the image carrier by developing the latent image with toner. The image forming units 21Y, 21M, 21C, and 21K sequentially superimpose the toner images of the respective colors onto the intermediate transfer belt 24 that circulates in a direction of an arrow F1 in cooperation with the primary transfer rollers 22Y, 22M, 22C, and 22K, respectively, to perform primary transfer. Therefore, when the intermediate transfer belt 24 passes the position of the most downstream image forming unit 21K, a color image in which the toner images of the four colors are superimposed is formed on the surface of the intermediate transfer belt 24. The toner images formed on the intermediate transfer belt 24 then comes into contact with the sheet 9 conveyed by the conveyor 2 when passing through the position facing the secondary transfer roller 25, and is secondarily transferred to the surface of the sheet 9.

Figure 2:
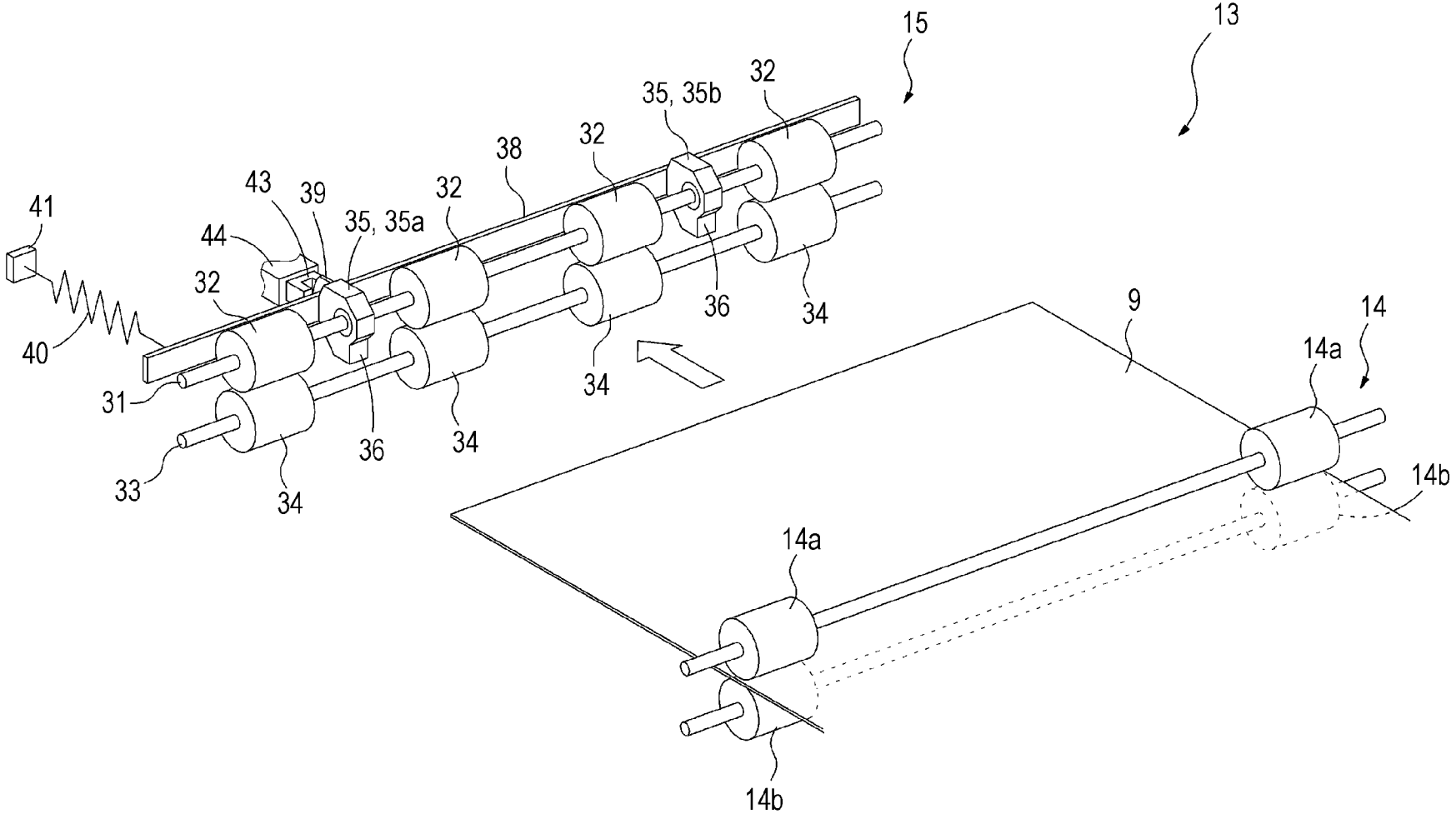
FIG. 2 is a diagram illustrating a configuration example of a skew corrector according to one or more embodiments.

Next, the configuration of the skew corrector 13 will be described. FIG. 2 is a diagram illustrating a configuration example of the skew corrector 13. The pair of conveyance rollers 14 includes a plurality of rollers 14*a* and 14*b* disposed so as to face each other with the conveyance path 12 therebetween, and sandwiches two portions of the sheet 9 to convey the sheet 9 in a direction indicated by an arrow in the figure. The conveyance rollers 14 are disposed on the upstream side of the registration rollers 15 in the conveyance path 12 of the sheet 9 and conveys the sheet 9 fed by the sheet feeding rollers 11 toward the registration rollers 15.

The pair of registration rollers 15 includes a plurality of rollers 32 and 34 arranged to face each other with the conveyance path 12 therebetween. The rollers 32 are attached to a rotation shaft 31 driven by a motor (not illustrated) and rotate together with the rotation shaft 31 when the rotation shaft 31 is driven to rotate in a predetermined direction. Such rollers 32 are provided at a plurality of locations (four locations in one or more embodiments) at predetermined intervals along the axial direction of the rotation shaft 31. The rollers 34 are attached to a rotation shaft 33 and rotates in a predetermined direction together with the rotation shaft 33. Such rollers 34 are also provided at a plurality of locations (four locations in one or more embodiments) at predetermined intervals along the axial direction of the rotation shaft 33 and are disposed so as to face the respective rollers 32. The registration rollers 15 convey the sheet 9 further downstream by sandwiching the sheet 9 at each of the nip parts between the rollers 32 and 34 and causing the rollers 32 and 34 to rotate.

The registration roller 15 is further attached with gate members 35*a* and 35*b* in a freely rotatable manner at two positions on the rotation shaft 31 attached with the rollers 32. Therefore, even when the rotation shaft 31 and the rollers 32 are driven to rotate in the predetermined direction, the gate members 35*a* and 35*b* do not rotate with the rotation shaft 31 or the rollers 32 and can swing around the rotation shaft 31 independently of the rotation shaft 31 or the rollers 32. Moreover, the two gate members 35*a* and 35*b* provided to the rotation shaft 31 are integrally connected by a connecting bar 38 provided at a position not interfering with the rollers 32. Therefore, the two gate members 35*a* and 35*b* integrally swing together around the rotation shaft 31. These gate members 35*a* and 35*b* are provided at symmetrical positions on both sides with respect to, for example, the center part in the longitudinal direction of the rotation shaft 31, and perform skew correction of the sheet 9. Note that when it is not necessary to distinguish between the two gate members 35*a* and 35*b* in the following description, they are collectively referred to as the gate members 35.

Each of the gate members 35*a* and 35*b* has a sheet locking part 36 that contacts the front end of the sheet 9 to lock the front end of the sheet 9. The gate members 35*a* and 35*b* can swing between a first attitude, in which the sheet locking parts 36 are disposed at predetermined positions on the upstream side of the nip parts of the registration rollers 15 to allow the front end of the sheet 9 to be locked at the sheet locking parts 36, and a second attitude in which the sheet locking parts 36 are retracted to the downstream side of the nip parts of the registration rollers 15 to allow the sheet 9 to pass therethrough. Then, the gate members 35*a* and 35*b* perform skew correction of the sheet 9 in the first attitude before the sheet 9 is guided to the nip parts of the registration rollers 15 and are displaced from the first attitude to the second attitude after performing the skew correction of the sheet 9 to guide the sheet 9 to the nip parts of the registration rollers 15.

Figure 3:
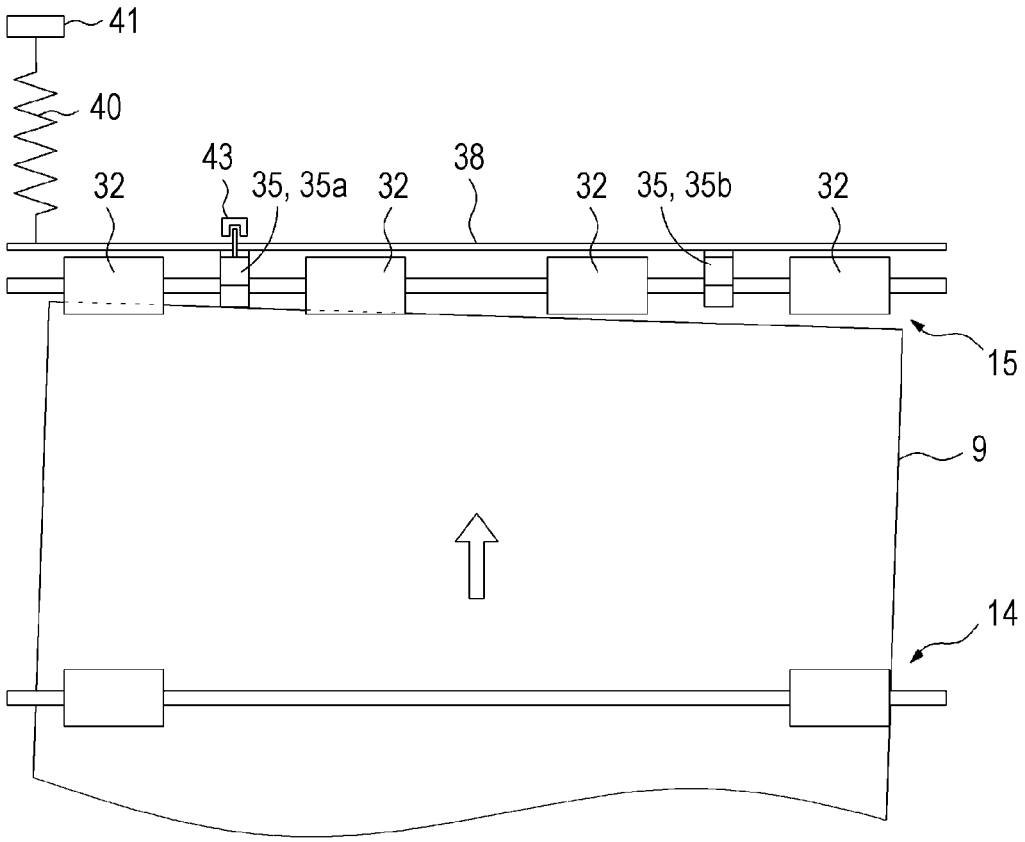
FIG. 3 is a plan view for explaining the concept of sheet skew correction according to one or more embodiments.
Figure 4:
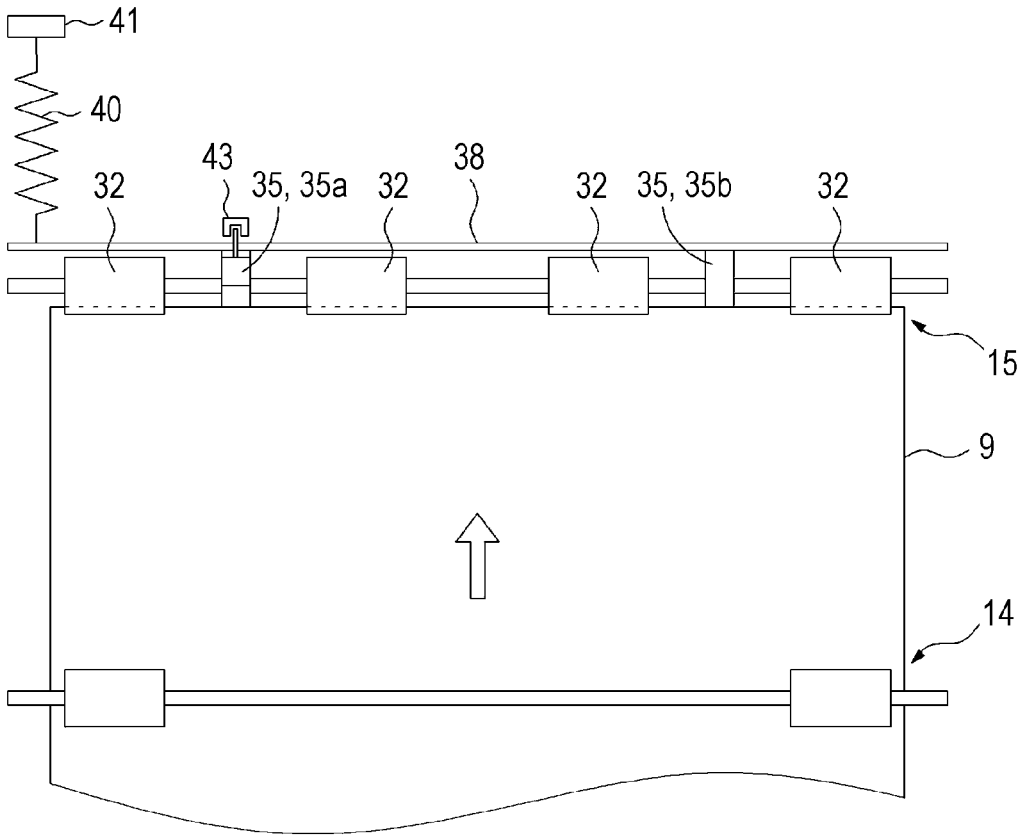
FIG. 4 is a plan view for explaining the concept of sheet skew correction according to one or more embodiments.

FIGS. 3 and 4 are a plan views for explaining the concept of skew correction of the sheet 9. First, in a case where the sheet 9 is conveyed in a skewed state as illustrated in FIG. 3, the front end of the sheet 9 first comes into contact with the sheet locking part 36 of the gate member 35*a* of the two gate members 35*a* and 35*b*. When the front end of the sheet 9 is in contact with only the sheet locking part 36 of the gate member 35*a* of the two gate members 35*a* and 35*b* in this manner, the sheet 9 cannot push the sheet locking part 36, and the front end of the sheet 9 locked by the sheet locking part 36 stays in that position.

The sheet conveyance by the conveyance rollers 14 is further continued, and when the subsequent portion of the sheet 9 further proceeds in the conveyance direction, the front end of the sheet 9 eventually comes into contact with the sheet locking part 36 of the other gate member 35*b* of the two gate members 35*a* and 35*b* as illustrated in FIG. 4. When the front end of the sheet 9 is locked by both of the sheet locking parts 36 of the two gate members 35*a* and 35*b* in this manner, the skew correction of the sheet 9 is completed. When the front end of the sheet 9 comes into contact with both of the sheet locking parts 36 of the two gate members 35*a* and 35*b*, the sheet 9 pushes the sheet locking parts 36 to the downstream side by the conveying force of the conveyance rollers 14 and the rigidity of the sheet 9 itself. At this point, the gate members 35*a* and 35*b* rotate around the rotation shaft 31 to be displaced from the first attitude to the second attitude.

Figure 5:
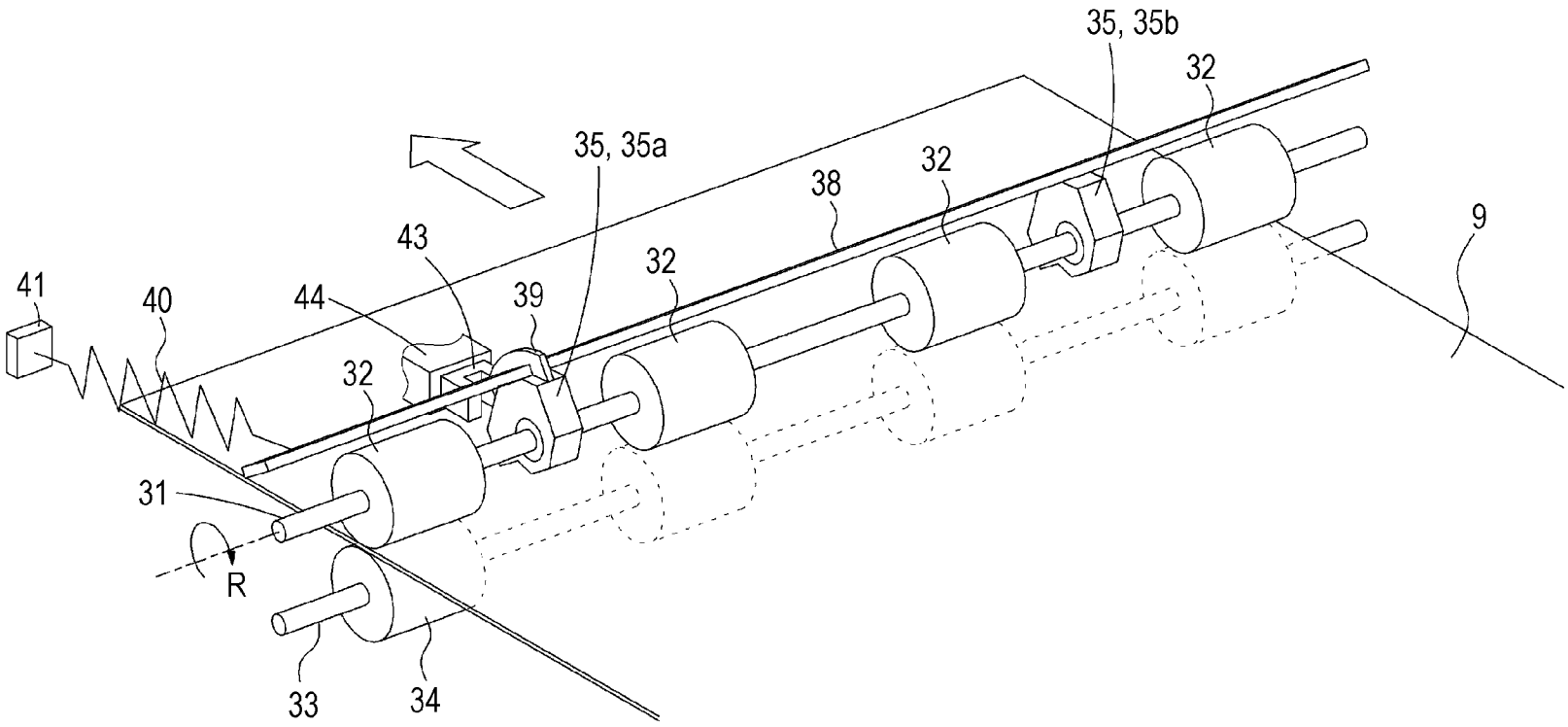
FIG. 5 is a view illustrating a state where gate members are displaced to a second attitude according to one or more embodiments.

FIG. 5 is a view illustrating a state where the gate members 35*a* and 35*b* are displaced to the second attitude. When the sheet 9 pushes the sheet locking parts 36 of the two gate members 35*a* and 35*b* and proceeds downstream, the sheet 9 proceeds to the nip parts between the rollers 32 and the rollers 34 of the registration rollers 15. Then the sheet 9 is sandwiched in the nip parts of the rollers 32 and the rollers 34, and is further conveyed downstream in the conveyance direction by the conveyance force of the registration rollers 15.

The skew corrector 13 as described above includes an energizing member 40 for causing the gate members 35*a* and 35*b* to recover to the original first attitude after the rear end of the sheet 9 has passed through the gate members 35*a* and 35*b*. The energizing member 40 includes, for example, a coil spring and has one end connected to a securing part 41 inside the apparatus and the other end is connected to the connecting bar 38. The energizing member 40 constantly applies the energizing force to hold the gate members 35*a* and 35*b* in the first attitude. When the gate members 35*a* and 35*b* swing and are displaced to the second attitude, the energizing member 40 applies a greater energizing force to the gate members 35*a* and 35*b* so as to cause the gate members 35*a* and 35*b* to recover to the first attitude. When the rear end of the sheet 9 passes through the gate members 35*a* and 35*b*, the energizing member 40 causes the gate members 35*a* and 35*b* to recover to the original first attitude by its own energizing force.

Figure 6A:
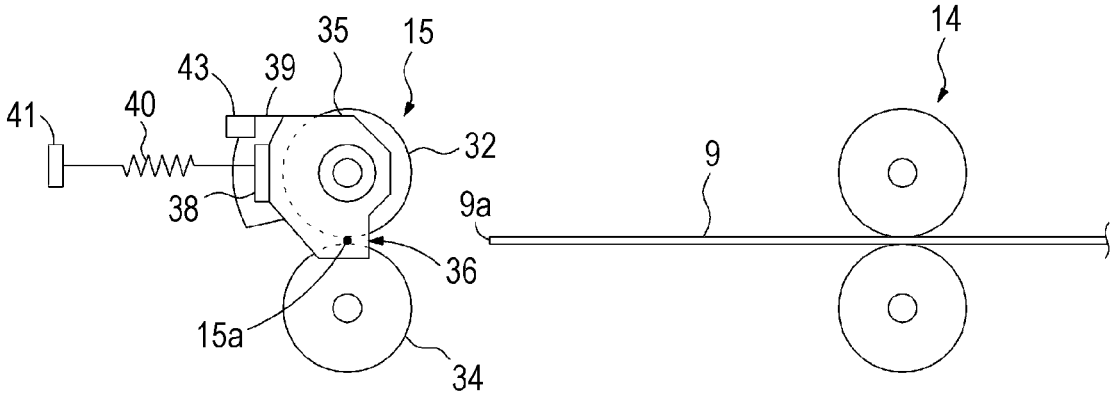
FIGS. 6A to 6C are side views illustrating the attitude change of the gate members according to one or more embodiments.
Figure 6B:
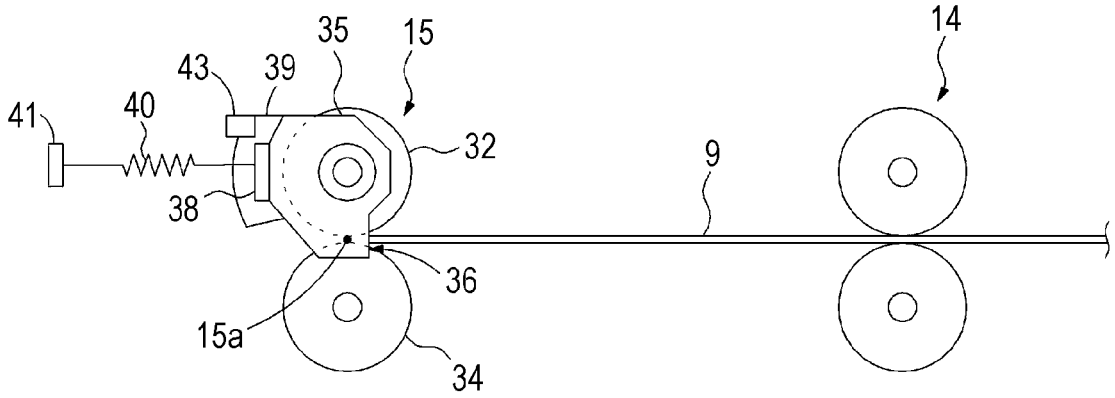
Figure 6C:
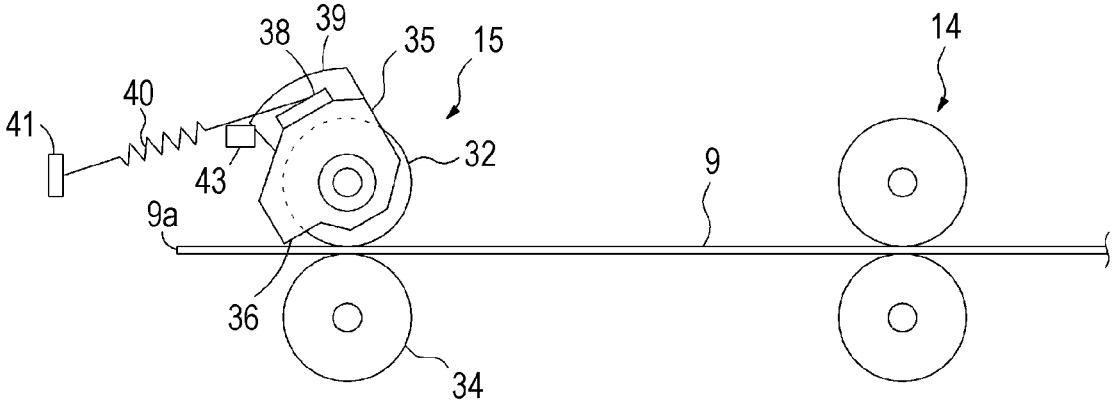

FIGS. 6A to 6C are side views illustrating the attitude change of the gate members 35. In FIG. 6A, the gate members 35 are in the first attitude. In this first attitude, the sheet locking parts 36 are at a predetermined position on the upstream side of nip parts 15*a* of the registration rollers 15. When the gate members 35 are in the first attitude, the sheet 9 is conveyed to the registration rollers 15 by the conveyance rollers 14. Then, when a front end 9*a* of the sheet 9 is locked by the two sheet locking parts 36 as illustrated in FIG. 6B, the skew correction of the sheet 9 is performed. Until the skew correction is completed, the gate members 35 maintain the first attitude. When the skew correction is completed when the front end 9*a* of the sheet 9 is in contact with the two sheet locking parts 36, the sheet 9 causes the gate members 35 to swing and to be displaced to the second attitude as illustrated in FIG. 6C. When the gate members 35 are displaced to the second attitude, the sheet locking parts 36 moves to the downstream side of the nip parts 15*a* of the registration rollers 15, thus resulting in a state where another sheet 9 can pass. Then the gate members 35 maintain the second attitude until the rear end of the sheet 9 passes therethrough. When thereafter the rear end of the sheet 9 passes through the gate members 35, the gate members 35 returns to the first attitude illustrated in FIG. 6A by the energizing force of the energizing member 40.

The skew corrector 13 as described above includes a sensor 43 that detects the attitude of the gate members 35, for example, on the back side (downstream side in the conveyance direction) of the connecting bar 38. The sensor 43 is arranged independently of the connecting bar 38 and the gate members 35, and is attached to, for example, a securing part 44 inside the apparatus. The sensor 43 includes an optical sensor in which, for example, a light projector and a light receiver are arranged to face each other. Meanwhile, the connecting bar 38 is provided with a light shielding plate 39 inserted between the light projector and the light receiver of the sensor 43. The light shielding plate 39 is integrated with a gate member 35 and swings around the rotation shaft 31 to guide the light emitted from the light projector to the light receiver or to block the light depending on the attitude change of the gate members 35. The sensor 43 can detect the attitude of the gate members 35 by detecting a light-receiving state or a light-shielding state corresponding to the position of the light shielding plate 39.

For example, the sensor 43 is used to detect that the front end 9*a* of the sheet 9 has reached the position of the nip parts 15*a* of the registration rollers 15. Therefore, the controller 7 can detect a state in which the front end 9*a* of the sheet 9 is held by the pair of registration rollers 15 on the basis of the output from the sensor 43 and can temporarily stop the conveyance of the sheet 9 at the timing at which this state is detected. Thereafter, the controller 7 re-drives the registration rollers 15 at the timing at which the toner image formed by the image former 3 moves to the position of the secondary transfer roller 25 and conveys the sheet 9 towards the secondary transfer roller 25.

In one or more embodiments, the sensor 43 is also used to detect deterioration of the energizing member 40. That is, since the sensor 43 can detect the attitude of the gate members 35, the deterioration state of the energizing member 40 is detected using an output signal of the sensor 43. There are several approaches for detecting the deterioration of the energizing member 40 using the sensor 43. Hereinafter, one or more embodiments for implementing these approaches will be described.

Since the energizing force decreases as the deterioration of the energizing member 40 progresses, the time for the gate members 35 to return from the second attitude to the first attitude gradually increases. Therefore, in one or more embodiments, an example will be described in which the deterioration of the energizing member 40 is detected by measuring required recovery time that is required for the gate members 35 to recover from the second attitude to the first attitude.

Figure 7A:
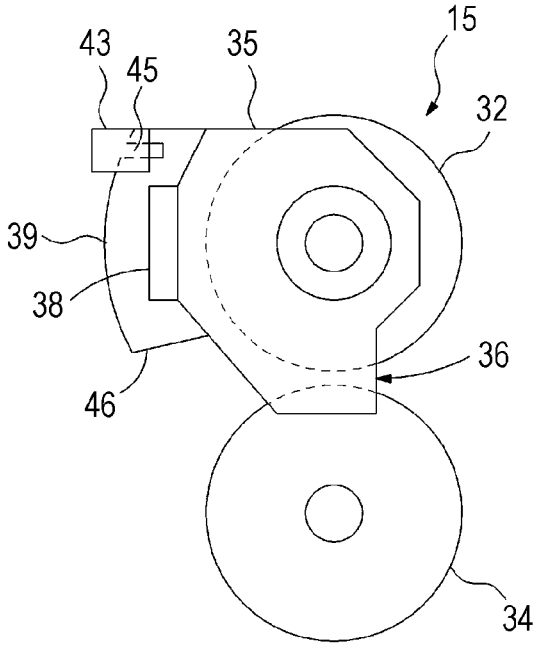
FIGS. 7A and 7B are diagrams illustrating a configuration example of a light shielding plate according to one or more embodiments.
Figure 7B:
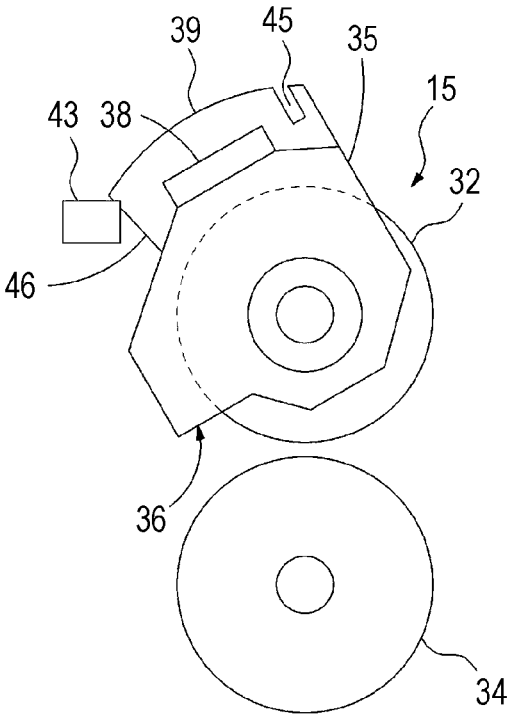

FIGS. 7A and 7B are diagrams illustrating a configuration example of a light shielding plate 39 of one or more embodiments. As illustrated in FIG. 7A, the light shielding plate 39 has a slit 45 that is in the same position as the sensor 43 when the gate members 35 are in the first attitude. Therefore, when the gate members 35 are in the first attitude, the sensor 43 is in the light-receiving state. The light shielding plate 39 also has an edge 46. The edge 46 moves above the sensor 43 when the gate members 35 are displaced to the second attitude as illustrated in FIG. 7B. Therefore, the sensor 43 is in the light-receiving state also when the gate members 35 are in the second attitude.

On the other hand, when the gate members 35 are in the process of shifting from the first attitude to the second attitude, the sensor 43 is in a light-shielding state. Similarly, when the gate members 35 are in the process of shifting from the second attitude to the first attitude, the sensor 43 is in a light-shielding state.

After starting the conveyance of the sheet 9 and detecting that the gate members 35 has changed from the first attitude to the second attitude based on an output signal from the sensor 43, the controller 7 determines whether the energizing member 40 has been deteriorated by measuring required recovery time by measuring time during which the light-shielding state, which lasts until the gate members 35 return from the second attitude to the first attitude, has been detected.

Figure 8:
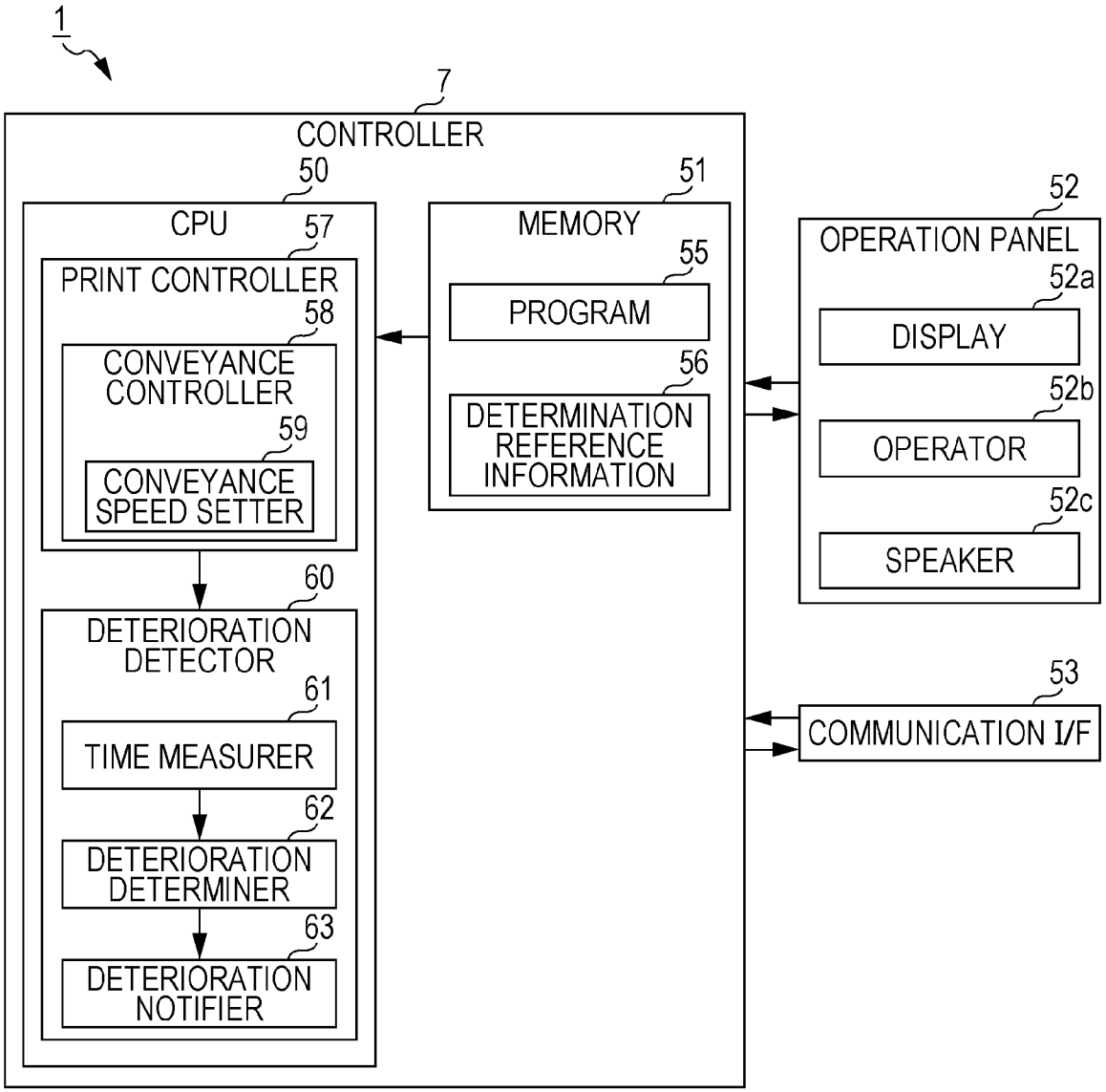
FIG. 8 is a block diagram illustrating an example of a hardware configuration and a functional configuration of a controller according to one or more embodiments.

FIG. 8 is a block diagram illustrating an example of a hardware configuration and a functional configuration of the controller 7. The controller 7 includes a CPU 50 and a memory 51 as its hardware configuration. The CPU 50 is an arithmetic processing unit that executes various programs. The memory 51 is a non-volatile storage device that stores a program 55 and determination reference information 56. The image forming apparatus 1 further includes an operation panel 52 and a communication interface 53. The controller 7 is connected to each of the operation panel 52 and the communication interface 53. The operation panel 52 is a user interface and includes a display 52*a*, an operator 52*b*, and a speaker 52*c*. The communication interface 53 is an interface for performing communication by connecting the image forming apparatus 1 to a network such as a local area network (LAN).

When the power is input to the image forming apparatus 1, the CPU 50 reads and executes the program 55 prestored in the memory 51. With this configuration, the CPU 50 functions as a print controller 57 and a deterioration detector 60.

The print controller 57 controls printing output based on a print job when the print job is received via the communication interface 53, for example. For example, when the execution of a print job is started, the print controller 57 drives and controls the conveyor 2, the image former 3, and the fixer 4 so that image formation is performed on a sheet 9. The print controller 57 includes a conveyance controller 58. The conveyance controller 58 controls conveyance of the sheet 9 by driving the conveyor 2. Furthermore, the conveyance controller 58 includes a conveyance speed setter 59. The conveyance speed setter 59 sets an optimum conveyance speed depending on the type, the resolution, or the like of the sheet 9 specified in the print job at the start of execution of the print job. Then, the conveyance controller 58 controls the conveyance of the sheet 9 by reflecting the conveyance speed set by the conveyance speed setter 59.

When the feeding conveyance of the sheet 9 is started by the conveyance controller 58, the deterioration detector 60 is activated. The deterioration detector 60 performs deterioration detection processing of the energizing member 40 on the basis of an output signal of the sensor 43 described above. The deterioration detector 60 includes a time measurer 61, a deterioration determiner 62, and a deterioration notifier 63.

After detecting that the gate members 35 have entered the second attitude, the time measurer 61 measures required recovery time that is required for recovery from the second attitude to the first attitude. For example, the time measurer 61 starts measurement of time when the sensor 43 detects a light-shielding state when the gate members 35 return from the second attitude to the first attitude. When the light-receiving state is detected by the sensor 43, the measurement of time is terminated. The time measured in this manner is the required recovery time. If deterioration of the energizing member 40 progresses as described above, the required recovery time gradually increases accordingly.

The deterioration determiner 62 is a processor that determines the deterioration of the energizing member 40. The deterioration determiner 62 reads the determination reference information 56 and determines whether the required recovery time is longer than or equal to a reference value registered in the determination reference information 56. For example, in a case where the conveyance speed of a sheet 9 is 240 mm/s and the sheet interval during consecutive conveyance is 60 mm, the time length from passage of the rear end of the sheet 9 to arrival of the front end of a next sheet 9 is 250 ms. In this case, a value less than or equal to 250 ms is registered in the determination reference information 56 as a reference value. However, some margin may be provided so that the rear end of the sheet 9 does not overlap the front end of the next sheet 9. Assuming that the margin is 50 ms, for example, a value of 200 ms is registered in the determination reference information 56 as a reference value. In the case where the reference value is 200 ms as described above, the deterioration determiner 62 determines whether the required recovery time is longer than or equal to 200 ms.

In a case where the required recovery time is greater than or equal to the reference value, the deterioration determiner 62 determines that the energizing member 40 is deteriorated. That is, the deterioration determiner 62 determines that the skew correction of the sheet 9 will not be normally performed in a near future due to a decrease in the energizing force of the energizing member 40 and that replacement time of the energizing member 40 has arrived. On the other hand, in a case where the required recovery time is less than the reference value, the deterioration determiner 62 determines that the energizing member 40 has not been deteriorated.

The deterioration notifier 63 is activated when the deterioration determiner 62 determines that the energizing member 40 is deteriorated. The deterioration notifier 63 is a processor that notifies a user or an external server that the energizing member 40 has been deteriorated. For example, the deterioration notifier 63 displays a warning screen on the display 52*a* of the operation panel 52 and thereby announces the user that the energizing member 40 has been deteriorated and that the replacement time of the energizing member 40 has arrived. The deterioration notifier 63 may also announce the user by outputting sound from the speaker 52*c* of the operation panel 52. This allows the user to request replacement work from a maintenance person at appropriate timing. Furthermore, the deterioration notifier 63 accesses a predetermined external server via the communication interface 53 and notifies the server that the energizing member 40 has been deteriorated. As a result, the server can instruct a maintenance person to perform the replacement work, thus allowing the maintenance person to be dispatched at appropriate timing without a request from the user.

Figure 9:
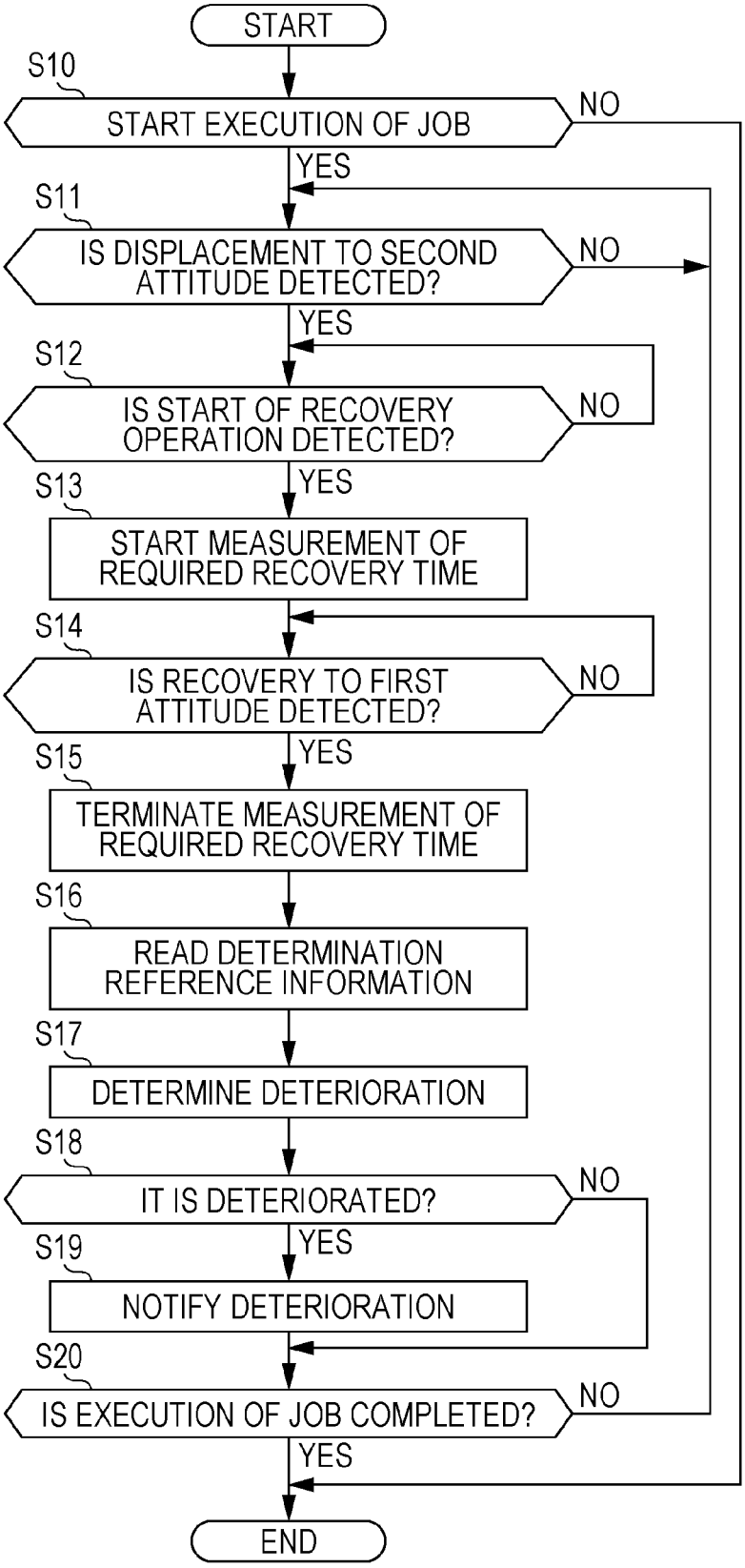
FIG. 9 is a flowchart illustrating an example of a processing procedure performed by a deterioration detector according to one or more embodiments.

FIG. 9 is a flowchart illustrating a processing procedure performed by the deterioration detector 60 of one or more embodiments. This processing is repeatedly performed by the controller 7 while the image forming apparatus 1 is activated. When this processing is started, the deterioration detector 60 determines whether execution of a print job is started (step S10). If execution of the print job is started (YES in step S10), the deterioration detector 60 stands by until it is detected that the gate members 35 are displaced to the second attitude (step S11). When it is detected that the gate members 35 are displaced to the second attitude (YES in step S11), the deterioration detector 60 stands by until the start of recovery operation of the gate members 35 are detected thereafter (step S12). When the start of the recovery operation of the gate members 35 are detected (YES in step S12), the deterioration detector 60 starts measurement of the required recovery time (step S13). This measurement operation continues until it is detected that the gate members 35 has recovered to the first attitude (step S14). When it is detected that the gate members 35 have recovered to the first attitude (YES in step S14), the deterioration detector 60 terminates the measurement of the required recovery time (step S15).

When the measurement of the required recovery time is terminated, the deterioration detector 60 reads the determination reference information 56 and performs deterioration determination of the energizing member 40 (step S17). That is, the deterioration detector 60 determines whether the energizing member 40 is deteriorated by comparing the required recovery time with the reference value of the determination reference information 56. As a result, if it is determined that the energizing member 40 is deteriorated (YES in step S18), the deterioration detector 60 notifies a user or an external server of the deterioration (step S19). On the other hand, if it is determined that the energizing member 40 is not deteriorated (NO in step S18), the deterioration detector 60 does not perform deterioration notification.

Thereafter, the deterioration detector 60 determines whether execution of the print job has been completed (step S20). If the print job has not been completed (NO in step S20), the flow returns to step S11 and repeats the above-described processing. Therefore, the deterioration determination processing is performed every time a sheet 9 is conveyed in a print job. On the other hand, if the print job has been completed (YES in step S20), the processing by the deterioration detector 60 ends.

Next, processing for the deterioration detector 60 to predict replacement time of the energizing member 40 will be described. The deterioration detector 60 is capable of predicting about when the replacement time of the energizing member 40 will arrive by recording required recovery time every time the required recovery time is measured by the time measurer 61 and analyzing the changes in the required recovery time over time.

Figure 10:
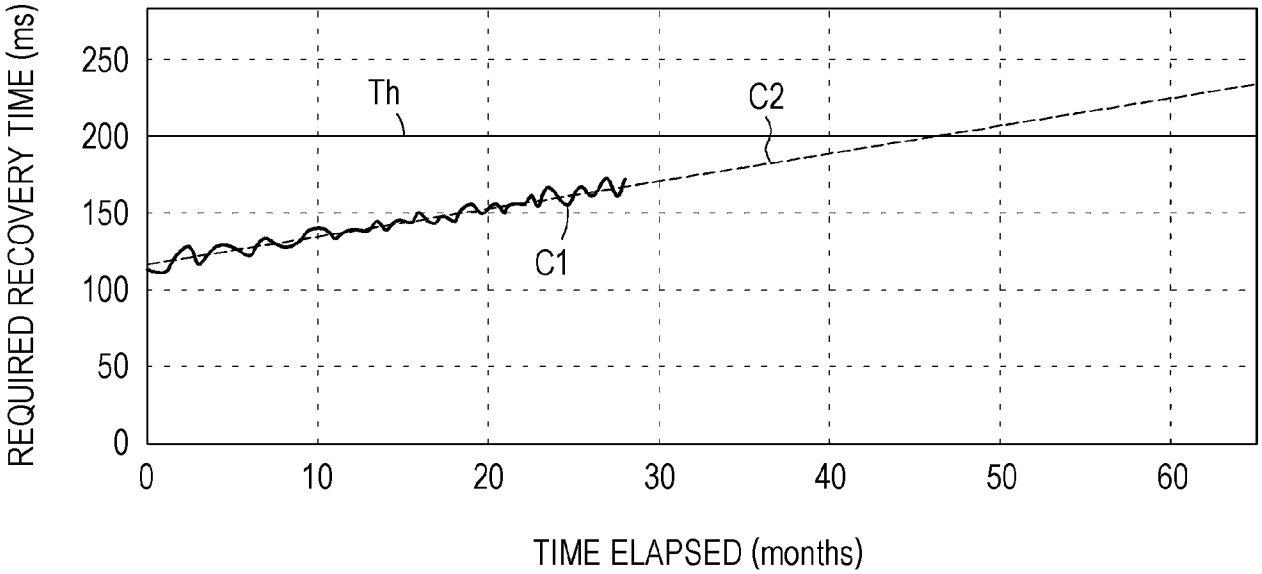
FIG. 10 is a graph illustrating an example of the change with time of required recovery time according to one or more embodiments.

FIG. 10 is a graph illustrating an example of the change with time of the required recovery time. Since the required recovery time measured by the time measurer 61 varies, it is represented as a solid line C1 in FIG. 10, for example. For example, every time a certain period (for example, one month) elapses, the deterioration detector 60 calculates a characteristic line C2 obtained by linearly approximating the solid line C1 based on the required recovery time that has been accumulated. Then, the deterioration detector 60 predicts the timing at which the characteristic line C2 exceeds or equals to a reference value Th registered in the determination reference information 56. That is, the deterioration detector 60 predicts the replacement time of the energizing member 40. Then the deterioration detector 60 may notify a user or an external server of the replacement time of the energizing member 40 on the basis of the prediction result.

As described above, the image forming apparatus 1 of one or more embodiments includes the deterioration detector 60 that detects deterioration of the energizing member 40 that energizes the gate members 35 to maintain the first attitude. The deterioration detector 60 determines the deterioration state of the energizing member 40 by measuring the required recovery time that is required for the gate members 35 to recover from the second attitude to the first attitude and determining whether the required recovery time is longer than or equal to a predetermined reference value. This configuration enables constant monitoring of the deterioration state of the energizing member 40, thus allowing the replacement time of the energizing member 40 to be accurately grasped. Therefore, the energizing member 40 can be replaced at appropriate timing.

Since the energizing force decreases as the deterioration of the energizing member 40 progresses, the resistance force when the gate members 35 are displaced from the first attitude to the second attitude decreases. Therefore, as the deterioration of the energizing member 40 progresses, the time required for the gate members 35 to be displaced from the first attitude to the second attitude gradually becomes shorter. Therefore, in one or more embodiments, an example will be described in which the deterioration of the energizing member 40 is detected by measuring required displacement time that is required for the gate members 35 to be displaced from the first attitude to the second attitude.

Figure 11A:
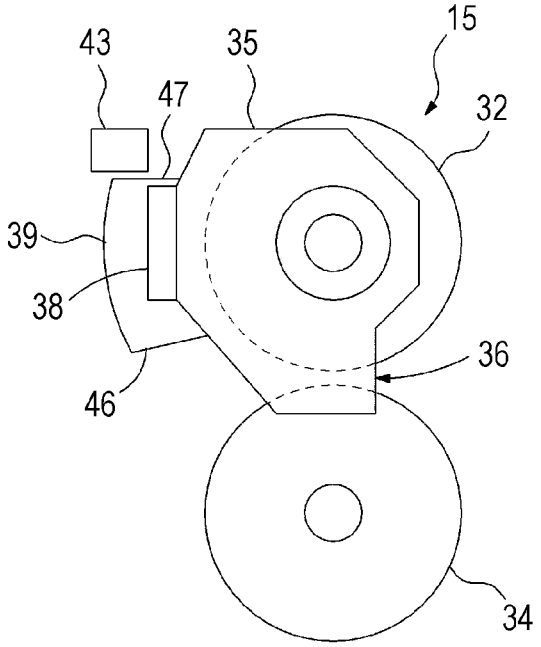
FIGS. 11A and 11B are diagrams illustrating another configuration example of a light shielding plate according to one or more embodiments.
Figure 11B:
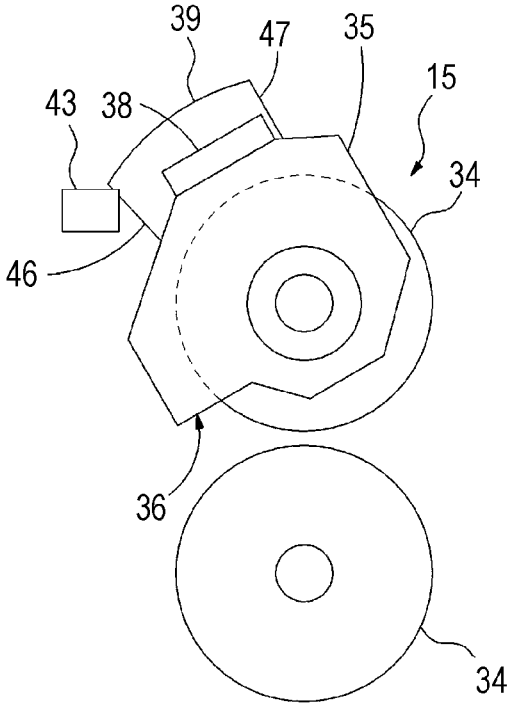

FIGS. 11A and 11B are diagrams illustrating a configuration example of a light shielding plate 39 of one or more embodiments. In one or more embodiments, the light shielding plate 39 has two edges 46 and 47. As illustrated in FIG. 11A, when the gate members 35 are in the first attitude, the edge 47 is at a lower position than the sensor 43. When the gate members 35 are in the first attitude, the sensor 43 is in the light-receiving state. Meanwhile, when the gate members 35 are displaced to the second attitude, the edge 46 moves above the sensor 43 as illustrated in FIG. 11B. Therefore, the sensor 43 is in the light-receiving state also when the gate members 35 are in the second attitude.

On the other hand, when the gate members 35 are in the process of being displaced from the first attitude to the second attitude, the sensor 43 is in a light-shielding state. Similarly, also when the gate members 35 are in the process of recovering from the second attitude to the first attitude, the sensor 43 is in a light-shielding state.

The configuration of the controller 7 is similar to that described in the above embodiments. After starting conveyance of a sheet 9 and detecting entry into the light-shielding state on the basis of an output signal from the sensor 43, the controller 7 determines whether the energizing member 40 has been deteriorated by measuring the required displacement time by measuring the time during which the light-shielding state lasts.

A time measurer 61 measures required displacement time. That is, when the conveyance of the sheet 9 is started by a print controller 57, the time measurer 61 measures the time during which the sensor 43 is in the light-shielding state as the required displacement time.

The deterioration determiner 62 determines whether the energizing member 40 is deteriorated based on the required displacement time. At this point, as in the above embodiments, the deterioration determiner 62 reads determination reference information 56 and determines the deterioration state by comparing a reference value registered in the determination reference information 56 with the required displacement time. As described above, as the deterioration of the energizing member 40 progresses, the required displacement time gradually becomes shorter. Therefore, the deterioration determiner 62 determines whether the required displacement time measured by the time measurer 61 is less than or equal to the reference value. In a case where the required displacement time is less than or equal to the reference value, the deterioration determiner 62 determines that the energizing member 40 is deteriorated. On the other hand, in a case where the required displacement time exceeds the reference value, the deterioration determiner 62 determines that the energizing member 40 is not deteriorated.

Meanwhile, the required displacement time that is required for the gate members 35 to be displaced from the first attitude to the second attitude varies depending on the type of a sheet 9. For example, in a case where the type of a sheet 9 is thin paper, the rigidity of the sheet 9 is weaker than that of plain paper or heavy paper. On the contrary, in a case where the type of a sheet 9 is heavy paper, the rigidity of the sheet 9 is stronger than that of plain paper or thin paper. Therefore, the force with which the sheet 9 pushes the sheet locking part 36 is the greatest for heavy paper, followed by plain paper, and then thin paper. Therefore, the required displacement time for the gate members 35 to be displaced from the first attitude to the second attitude tends to be shorter for heavy paper and longer for thin paper when plain paper is used as a reference.

Moreover, the required displacement time that is required for the gate members 35 to be displaced from the first attitude to the second attitude varies depending on the conveyance speed of a sheet 9. That is, the required displacement time becomes shorter when the conveyance speed is fast, and the required displacement time becomes longer when the conveyance speed is slow.

Therefore, in one or more embodiments, reference values corresponding to the type of a sheet 9 and the conveyance speed of a sheet 9 is registered in the determination reference information 56 in advance. FIGS. 12A and 12B are tables illustrating an example of the determination reference information 56. For example, the determination reference information 56 illustrated in FIG. 12A illustrates an example in which a reference value for determining the required displacement time is registered for each type of a sheet 9. Since the required displacement time tends to be longer for the case of thin paper than in the case of plain paper, a longer reference value than that for plain paper is registered. Since the required displacement time tends to be shorter for the case of heavy paper than in the case of plain paper, a shorter reference value than that for plain paper is registered. In this manner, by registering a reference value for each type of a sheet 9 in the determination reference information 56, the deterioration determiner 62 can read out the optimum reference value depending on the type of a sheet 9 specified in a print job and determine the required displacement time.

Meanwhile, the determination reference information 56 illustrated in FIG. 12B illustrates an example in which a reference value for determining the required displacement time depending on the conveyance speed of a sheet 9 is registered. For example in the case of plain paper, the conveyance speed of a sheet 9 is 240 mm/s when the resolution is 600 dpi, whereas the conveyance speed of a sheet 9 is 120 mm/s when the resolution is 1200 dpi. Therefore, there are cases where the conveyance speed of a sheet 9 changes even when the type of a sheet 9 is the same. Therefore, by registering reference values corresponding to the conveyance speed of a sheet 9 in the determination reference information 56, the deterioration determiner 62 can read out the optimum reference value depending on the conveyance speed of a sheet 9 specified in a print job and determine the required displacement time.

Note that the point that the deterioration notifier 63 notifies a user or an external server when the deterioration determiner 62 determines that the energizing member 40 is deteriorated is similar to the above embodiments.

Figure 13:
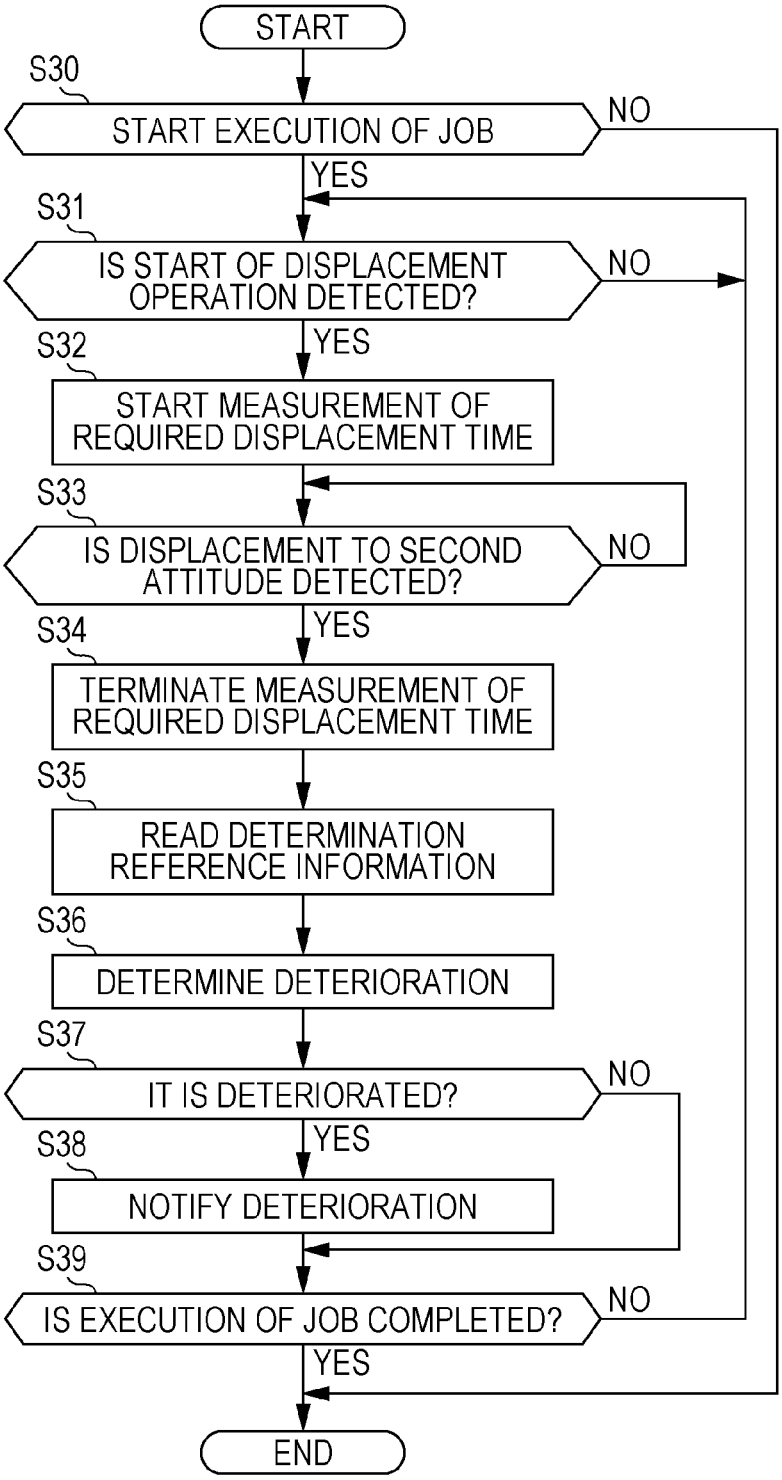
FIG. 13 is a flowchart illustrating another example of a processing procedure performed by the deterioration detector according to one or more embodiments.

FIG. 13 is a flowchart illustrating a processing procedure performed by the deterioration detector 60 of one or more embodiments. When this processing is started, the deterioration detector 60 determines whether execution of a print job is started (step S30). If execution of the print job is started (YES in step S30), the deterioration detector 60 stands by until start of displacement of the gate members 35 are detected (step S31). That is, the deterioration detector 60 stands by from the start of conveyance of the sheet 9 until the sensor 43 detects the light-shielding state. When the start of displacement of the gate members 35 is detected (YES in step S31), the deterioration detector 60 starts measurement of the required displacement time (step S32). This measurement operation continues until displacement of the gate members 35 to the second attitude is detected (step S33). When it is detected that the gate members 35 have been displaced to the second attitude (YES in step S33), the deterioration detector 60 terminates the measurement of the required displacement time (step S34).

When the measurement of the required displacement time is terminated, the deterioration detector 60 reads the determination reference information 56 and performs deterioration determination of the energizing member 40 (step S36). At this point, the deterioration detector 60 reads out a reference value corresponding to the type of the sheet 9 or the conveyance speed of the sheet 9 and compares the required displacement time with the reference value to determine whether the energizing member 40 is deteriorated. As a result, if it is determined that the energizing member 40 is deteriorated (YES in step S37), the deterioration detector 60 notifies a user or an external server of the deterioration (step S38). On the other hand, if it is determined that the energizing member 40 is not deteriorated (NO in step S38), the deterioration detector 60 does not perform deterioration notification.

Thereafter, the deterioration detector 60 determines whether execution of the print job has been completed (step S39). If the print job has not been completed (NO in step S39), the flow returns to step S31 and repeats the above-described processing. Therefore, the deterioration determination processing is performed every time a sheet 9 is conveyed in a print job. On the other hand, if the print job has been completed (YES in step S39), the processing by the deterioration detector 60 ends.

Meanwhile, also in one or more embodiments like in the above embodiments, the deterioration detector 60 is capable of predicting about when the replacement time of the energizing member 40 will arrive by recording required displacement time every time the required displacement time is measured by the time measurer 61 and analyzing the changes in the required displacement time over time. In this case, the deterioration detector 60 predicts the timing at which the required displacement time becomes less than or equal to the reference value, and notifies the user or the external server of the replacement time of the energizing member 40 on the basis of the prediction result.

As described above, the deterioration detector 60 in one or more embodiments determines the deterioration state of the energizing member 40 by measuring the required displacement time that is required for the gate members 35 to be displaced from the first attitude to the second attitude and determining whether the required displacement time is less than or equal to a predetermined reference value. Such a configuration also enables constant monitoring of the deterioration state of the energizing member 40, thus allowing the replacement time of the energizing member 40 to be accurately grasped. Therefore, the energizing member 40 can be replaced at appropriate timing.

Since the energizing force decreases as the deterioration of the energizing member 40 progresses, there are cases where the gate members 35 cannot be completely recovered to the original first attitude and stop in a state in which the position of the sheet locking parts 36 are shifted downstream from the initial position even when the operation of causing the gate members 35 to recover from the second attitude to the first attitude is performed. Therefore, in one or more embodiments, an example will be described in which deterioration of the energizing member 40 is detected by detecting the position of such sheet locking parts.

Figure 14A:
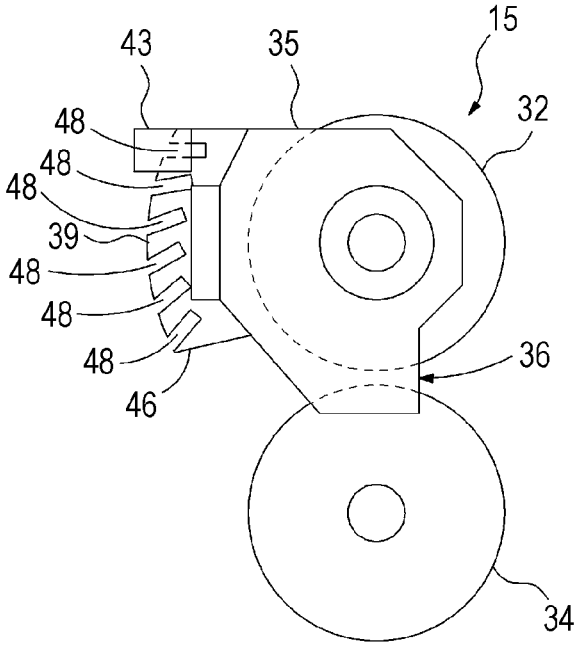
FIGS. 14A and 14B are diagrams illustrating still another configuration example of a light shielding plate according to one or more embodiments.
Figure 14B:
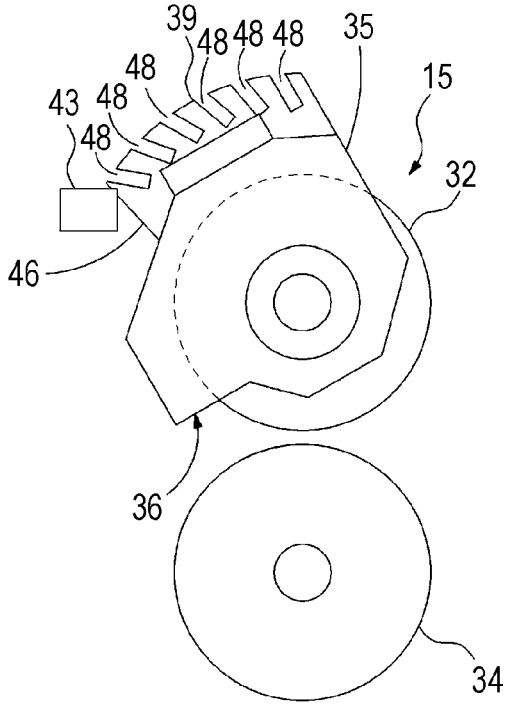

FIGS. 14A and 14B are diagrams illustrating a configuration example of a light shielding plate 39 of one or more embodiments. In one or more embodiments, the light shielding plate 39 has a plurality of slits 48. As illustrated in FIG. 14A, when the gate members 35 are in the first attitude, an uppermost slit 48 of the plurality of slits 48 is at the same position as the sensor 43. Therefore, when the gate members 35 are in the first attitude, the sensor 43 is in the light-receiving state. Meanwhile, when the gate members 35 are displaced to the second attitude, an edge 46 moves above the sensor 43 as illustrated in FIG. 14B. Therefore, even when the gate members 35 are in the second attitude, the sensor 43 is in the light-receiving state.

In addition, the plurality of slits 48 passes through the position of the sensor 43 when the gate members 35 are in the process of displacement from the first attitude to the second attitude. Therefore, when the gate members 35 are displaced from the first attitude to the second attitude, the sensor 43 repeats the light-receiving state and the light-shielding state and ultimately enters the light-receiving state. Similarly, also when the gate members 35 are in the process of recovering from the second attitude to the first attitude, the sensor 43 repeats the light-receiving state and the light-shielding state.

Figure 15:
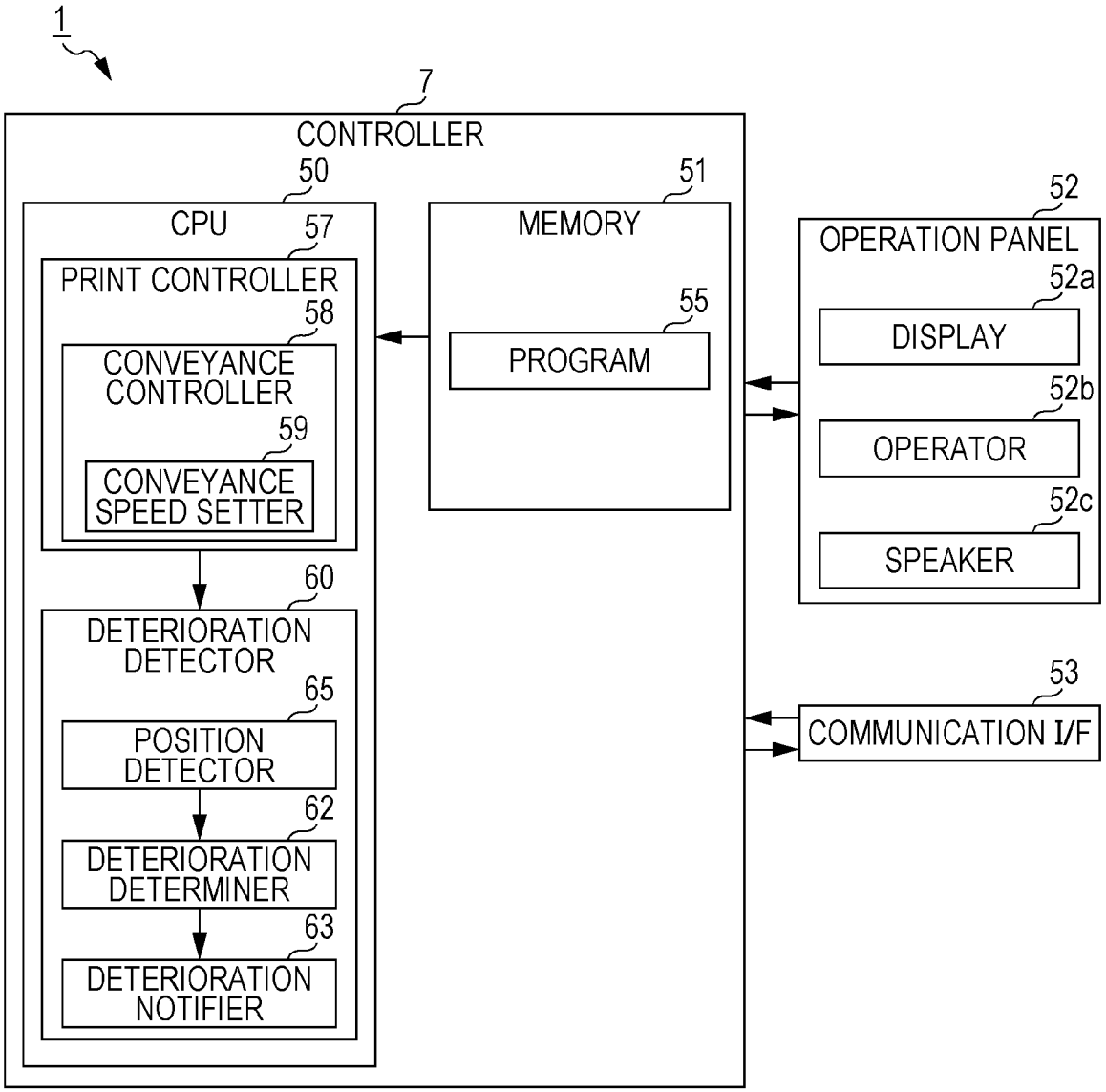
FIG. 15 is a block diagram illustrating another example of a hardware configuration and a functional configuration of a controller according to one or more embodiments.

FIG. 15 is a block diagram illustrating an example of a hardware configuration and a functional configuration of a controller 7 of one or more embodiments. The controller 7 differs from the above embodiments in the detailed configuration of the deterioration detector 60. That is, the deterioration detector 60 of one or more embodiments includes a position detector 65, a deterioration determiner 62, and a deterioration notifier 63.

The position detector 65 performs processing of detecting the position of the sheet locking parts 36 after the operation of recovering the gate members 35 from the second attitude to the first attitude is performed. Specifically explaining, the position detector 65 counts the number of slits 48 that have passed through the sensor 43 on the basis of output signals from the sensor 43 when the gate members 35 are displaced from the first attitude to the second attitude. The position detector 65 also counts the number of slits 48 that have passed through the sensor 43 on the basis of output signals from the sensor 43 also when the gate members 35 recovers from the second attitude to the first attitude. Then the position detector 65 compares the number of counts when the displacement operation is performed with the number of counts when the recovery operation is performed, and detects the position of the sheet locking parts 36 after the recovery operation.

For example, in a case where the number of counts when the displacement operation is performed is the same as the number of counts when the recovery operation is performed, this means that the gate members 35 have recovered to the first attitude that the gate members 35 have been in before the displacement operation. That is, in this case, the sheet locking parts 36 are recovered to the initial position.

On the other hand, in a case where the number of counts when the recovery operation is performed is smaller than the number of counts when the displacement operation is performed, this means that the gate members 35 are not returned to the first attitude that the gate members 35 have been in before the displacement operation. In this case, the position detector 65 can detect that the sheet locking parts 36 have stopped in a state where they are shifted downstream from the initial position.

Moreover, when the number of counts when the recovery operation is performed is smaller than the number of counts when the displacement operation is performed, the position detector 65 can detect the position of the sheet locking parts 36 more accurately on the basis of the difference in the number of counts. For example in a case where the number of counts when the recovery operation is performed is less than the number of counts when the displacement operation is performed by one or two, it is possible to detect that the sheet locking parts 36 are positioned on the upstream side of the nip parts 15*a* of the registration rollers 15. On the contrary, in a case where the number of counts when the recovery operation is performed is less than the number of counts when the displacement operation is performed by 3 or more, it is possible to detect that the sheet locking parts 36 is stopped on the downstream side of the nip parts 15*a* of the registration rollers 15.

When the position detector 65 detects the position of the sheet locking part 36 after the recovery operation is performed in the above manner, the position detector 65 outputs the position information to the deterioration determiner 62. The deterioration determiner 62 of one or more embodiments determines the deterioration of the energizing member 40 on the basis of the position information output from the position detector 65. For example, the deterioration determiner 62 may determine that the energizing member 40 is deteriorated when the position of the sheet locking parts 36 detected by the position detector 65 has moved downstream from the initial position. Alternatively, the deterioration determiner 62 may determine that the energizing member 40 is deteriorated when the position of the sheet locking parts 36 detected by the position detector 65 has moved downstream from the nip parts 15*a* of the registration rollers 15.

When the deterioration determiner 62 determines that the energizing member 40 is deteriorated, the deterioration notifier 63 notifies a user or an external server as described in the above embodiments.

As described above, the deterioration detector 60 of one or more embodiments detects the position of the sheet locking parts 36 after the operation of recovering the gate members 35 from the second attitude to the first attitude, and determines that the energizing member 40 is deteriorated when the position has moved downstream of the initial position. Such a configuration also enables constant monitoring of the deterioration state of the energizing member 40, thus allowing the replacement time of the energizing member 40 to be accurately grasped. Therefore, the energizing member 40 can be replaced at appropriate timing.

Note that, as described in one or more embodiments, it is also possible to apply, to the above embodiments, the approach of determining deterioration of the energizing member 40 by detecting the position of the sheet locking parts 36 after the operation of recovering the gate members 35 from the second attitude to the first attitude.

In the above embodiments, the cases where the image forming apparatus 1 determines deterioration of the energizing member 40 are exemplified. However, the deterioration determination of the energizing member 40 can be performed by an external server. In one or more embodiments, an example in which the deterioration determination of the energizing member 40 is performed by an external server will be described.

Figure 16:
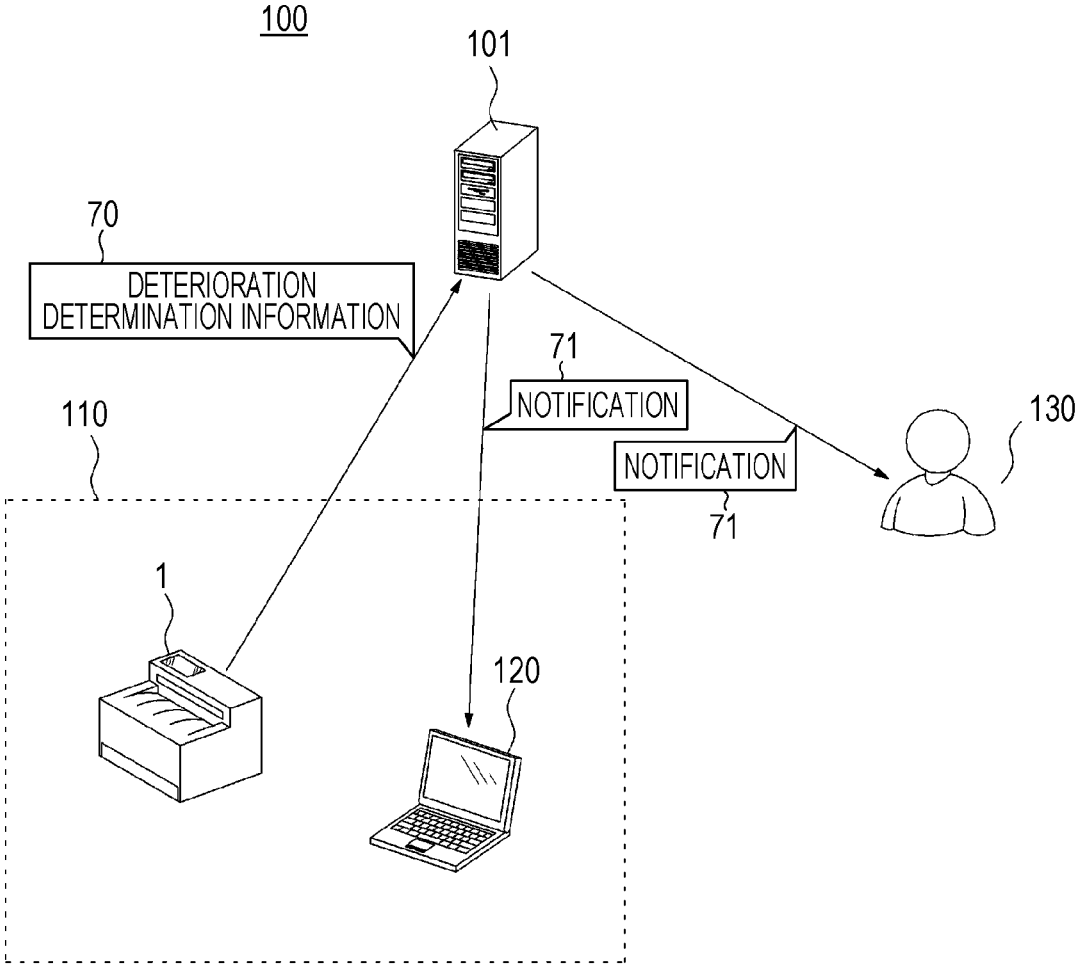
FIG. 16 is a diagram illustrating a configuration example of an image forming system according to one or more embodiments.

FIG. 16 is a diagram illustrating a configuration example of an image forming system 100 according to one or more embodiments. In the image forming system 100, the above-described image forming apparatus 1 and a server 101 can communicate with each other via a network such as a LAN or the Internet. The image forming apparatus 1 is installed in a local environment 110 of a user. The server 101 is, for example, installed on a cloud on the Internet. In addition, an information processing device 120 such as a personal computer (PC) that the user uses is installed in the user's local environment 110, and the server 101 can also communicate with such an information processing device 120.

In the configuration as described above, the image forming apparatus 1 acquires deterioration determination information 70 for determining the deterioration state of the energizing member 40 along with execution of a print job. The deterioration determination information 70 includes at least one of the required recovery time, the required displacement time, and the position information of the sheet locking parts 36 described in the above embodiments. Then, the image forming apparatus 1 transmits the deterioration determination information 70 to the server 101.

The server 101 includes a deterioration detector similar to the deterioration detector 60 described in the above embodiments. Therefore, when the server 101 acquires the deterioration determination information 70 from the image forming apparatus 1, the server 101 determines the deterioration of the energizing member 40 included in the image forming apparatus 1 on the basis of the deterioration determination information 70. When it is determined as a result of the above that the energizing member 40 is deteriorated, the server 101 notifies that the energizing member 40 is deteriorated. For example, the server 101 transmits a notification 71 to the information processing device 120 of the user installed in the local environment 110. This allows the user to grasp that the energizing member 40 of the image forming apparatus 1 is deteriorated from the information processing device 120 that the user uses. The server 101 also transmits, to a maintenance person, a notification 71 indicating that the energizing member 40 of the image forming apparatus 1 is deteriorated. As a result, the maintenance person can visit the local environment at appropriate timing to perform replacement work of the energizing member 40. Note that the server 101 may transmit the notification 71 to the image forming apparatus 1 as well.

Furthermore, as described in the above embodiments, the server 101 may predict the replacement time of the energizing member 40 and notify the user or a maintenance person of the prediction result.

As described above, one or more embodiments have an advantage that the deterioration state of the energizing member 40 of the image forming apparatus 1 installed in different places can be centrally managed since it is the server 101 that detects deterioration of the energizing member 40.

Variations

The above-disclosed embodiments are made for purposes of illustration and example only and not limitation, and various variations can be applied. The scope of the present invention should be interpreted by terms of the appended claims.

For example in the above-described embodiments, the case where the image forming apparatus 1 is a printer having only a print function has been described. However, an image forming apparatus of one or more embodiments of the present invention is not limited to a printer having only a print function. For example, the image forming apparatus 1 may be multifunction peripherals (MFP) or a facsimile. In the above-described embodiments, the image forming apparatus 1 capable of performing color output has been exemplified; however, the image forming apparatus 1 may be an apparatus capable of performing only monochrome output.

In the above-described embodiments, the example has been explained in which the sensor 43 includes an optical sensor including a light projector and a light receiver, and the attitude or the position of the gate members 35 are detected by detecting passage of a slit or an edge of the light shielding plate 39. However, the sensor 43 that detects the attitude or the position of the gate members 35 is not necessarily limited to an optical sensor. Furthermore, the configuration of the light shielding plate 39 is not limited to the one described above.

Furthermore, in the above embodiments, the cases where the program 55 executed by the CPU 50 of the controller 7 is prestored in the memory 51 are illustrated. However, the program 55 may be installed in the image forming apparatus 1 via the communication interface 53, for example. In this case, the program 55 is provided in a form downloadable via the Internet or the like. Alternatively, without being limited the above, and the program 55 may be provided in a form recorded on a computer-readable recording medium such as a CD-ROM or a USB memory.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus comprising:
- a conveyance path that conveys a sheet;
- registration rollers that are arranged across the conveyance path and each comprise a nip part;
- a rotator that is rotatably attached to at least one of the registration rollers and that comprises a sheet contact part locking a front end of a sheet conveyed in the conveyance path, wherein
  - the rotator swings between a first attitude and a second attitude,
  - in the first attitude the sheet contact part locks the sheet on an upstream side of the nip part, and
  - in the second attitude the sheet contact part is retracted to a downstream side of the nip part and allows the sheet to pass through the nip part;
- an energizer that energizes the sheet contact part to maintain the first attitude; and
- a hardware processor that determines deterioration of the energizer, wherein
- the hardware processor determines a recovery time that the sheet contact part requires to recover from the second attitude to the first attitude.

2. The image forming apparatus according to claim 1, wherein the hardware processor determines that the energizer is deteriorated when determining that the recovery time is longer than or equal to a predetermined period of time.

3. The image forming apparatus according to claim 2, wherein the predetermined period of time is set in advance to be shorter than a time length corresponding to a sheet interval in consecutive conveyance of a plurality of sheets.

4. The image forming apparatus according to claim 2, wherein the hardware processor predicts a deterioration timing at which the recovery time becomes longer than or equal to the predetermined period of time.

5. The image forming apparatus according to claim 1, further comprising:
- an attitude detector that is disposed in a vicinity of the sheet contact part and detects whether the sheet contact part is in the first attitude or the second attitude,
- wherein the hardware processor uses the attitude detector to measure, as the recovery time, a time that the sheet contact part requires to change from the second attitude to the first attitude.

6. An image forming apparatus comprising:
- a conveyance path that conveys a sheet;
- registration rollers that are arranged across the conveyance path and each comprise a nip part;
- a rotator that is rotatably attached to at least one of the registration rollers and that comprises a sheet contact part locking a front end of a sheet conveyed in the conveyance path, wherein
  - the rotator swings between a first attitude and a second attitude,
  - in the first attitude the sheet contact part locks the sheet on an upstream side of the nip part, and
  - in the second attitude the sheet contact part is retracted to a downstream side of the nip part and allows the sheet to pass through the nip part;
- an energizer that energizes the sheet contact part to maintain the first attitude; and
- a hardware processor that determines deterioration of the energizer, wherein
- the hardware processor determines a displacement time that the sheet contact part requires to be displaced from the first attitude to the second attitude.

7. The image forming apparatus according to claim 6, wherein the hardware processor determines that the energizer is deteriorated when determining that the displacement time is less than or equal to a predetermined period of time.

8. The image forming apparatus according to claim 7, wherein the predetermined period of time is set depending on a type of the sheet.

9. The image forming apparatus according to claim 7, wherein the predetermined period of time is set depending on a sheet conveyance speed.

10. The image forming apparatus according to claim 7, wherein the hardware processor predicts a deterioration timing at which the displacement time becomes less than or equal to the predetermined period of time.

11. The image forming apparatus according to claim 6, further comprising
- an attitude detector that is disposed in a vicinity of the sheet contact part and detects whether the sheet contact part is in the first attitude or the second attitude,
- wherein the hardware processor uses the attitude detector to measure, as the displacement time, a time that the sheet contact part requires to change from the first attitude to the second attitude.

12. The image forming apparatus according to claim 1, wherein the hardware processor further:

determines a position of the sheet contact part after causing the sheet contact part to recover from the second attitude to the first attitude, and determines that the energizer is deteriorated when the position of the sheet contact part has moved downstream from an initial position.

13. The image forming apparatus according to claim 12, wherein the hardware processor determines that the energizer is deteriorated when the position of the sheet contact part has moved downstream of the nip part.

14. The image forming apparatus according to claim 1, further comprising a notifier that provides notification to a user, wherein the hardware processor announces a replacement time of the energizer via the notifier when determining the deterioration of the energizer.

15. The image forming apparatus according to claim 1, further comprising a communicator that performs communication with a predetermined server, wherein the hardware processor notifies the server of the deterioration of the energizer via the communicator when determining the deterioration of the energizer.

16. An image forming system comprising an image forming apparatus and a server that communicate with each other, wherein the image forming apparatus comprises:

a conveyance path that conveys a sheet;

registration rollers that are arranged across the conveyance path and each comprise a nip part;

a rotator that is rotatably attached to at least one of the registration rollers and that comprises a sheet contact part locking a front end of a sheet conveyed in the conveyance path, wherein the rotator swings between a first attitude and a second attitude, in the first attitude the sheet contact part locks the sheet on an upstream side of the nip part, and in the second attitude the sheet contact part is retracted to a downstream side of the nip part and allows the sheet to pass through the nip part;

an energizer that energizes the sheet contact part to maintain the first attitude; and a first hardware processor that acquires deterioration determination information determining a deterioration state of the energizer; and a transmitter that transmits the deterioration determination information to the server, and the server comprises:

a second hardware processor that determines deterioration of the energizer based on the deterioration determination information; and a notifier that notifies the deterioration of the energizer when the second hardware processor determines the deterioration of the energizer, wherein the first hardware processor determines a recovery time that the sheet contact part requires to recover from the second attitude to the first attitude.

17. A deterioration detection method using an image forming apparatus comprising: a conveyance path that conveys a sheet; registration rollers that are arranged across the conveyance path and each comprise a nip part; a rotator that is rotatably attached to at least one of the registration rollers, comprises a sheet contact part locking a front end of a sheet conveyed in the conveyance path, and swings between a first attitude and a second attitude; an energizer that energizes the sheet contact part to maintain the first attitude; and an attitude detector that is disposed in a vicinity of the sheet contact part and detects whether the sheet contact part is in the first attitude or the second attitude, the deterioration detection method comprising:

determining a recovery time that the sheet contact part requires to recover from the second attitude to the first attitude, or a displacement time that the sheet contact part requires to be displaced from the first attitude to the second attitude, based on a detection result by the attitude detector; and determining deterioration of the energizer based on the recovery time or the displacement time, wherein in the first attitude the sheet contact part locks the sheet on an upstream side of the nip part, and in the second attitude the sheet contact part is retracted to a downstream side of the nip part and allows the sheet to pass through the nip part.

* * * * *